US008186552B2

(12) United States Patent
Huang

(10) Patent No.: US 8,186,552 B2
(45) Date of Patent: May 29, 2012

(54) STAPLER WITH LEG-FLATTING AND ANVIL-GUIDING CAPABILITY

(75) Inventor: Chi-Feng Huang, Chang Hua (TW)

(73) Assignee: SDI Corporation, Chang Hua (TW)

( * ) Notice: Subject to any disclaimer, the term of this patent is extended or adjusted under 35 U.S.C. 154(b) by 327 days.

(21) Appl. No.: 12/572,621

(22) Filed: Oct. 2, 2009

(65) Prior Publication Data

US 2011/0079625 A1 Apr. 7, 2011

(51) Int. Cl.
*B25C 5/02* (2006.01)

(52) U.S. Cl. ..... 227/61; 227/120; 227/132; 227/133; 227/134

(58) Field of Classification Search ..... 227/61, 227/120, 132, 133, 134
See application file for complete search history.

(56) References Cited

U.S. PATENT DOCUMENTS 4,206,863 A * 6/1980 Savino ..... 227/83
4,623,082 A * 11/1986 Kurosawa ..... 227/7
6,626,346 B2 * 9/2003 Jairam et al. ..... 227/127
6,840,422 B2 * 1/2005 Mintzer ..... 227/109
7,431,186 B2 * 10/2008 Hsu ..... 227/120
2003/0155400 A1 * 8/2003 Jairam et al. ..... 227/134
2007/0057011 A1 * 3/2007 Kandasamy et al. ..... 227/134
2010/0012701 A1 * 1/2010 Huang et al. ..... 227/132

* cited by examiner

*Primary Examiner* — Brian D Nash
(74) *Attorney, Agent, or Firm* — Hershkovitz & Associates, LLC; Abraham Hershkovitz

(57) ABSTRACT

A stapler has a supporting base, a magazine assembly, a trigger assembly, a leg-flatting device and a rail assembly. The magazine assembly and the trigger assembly are connected pivotally to the supporting base. The leg-flatting device is mounted on the supporting base and has a moving base and an anvil element. The moving base is connected operationally to the supporting base and has an anvil hole. The anvil element is mounted moveably in the anvil hole and has a functional segment and a non-functional segment. The rail assembly mounted on and protrudes from the bottom face of the supporting base and has at least one rail bracket protruding from the bottom face of the supporting base. Each one of the at least one rail bracket has a rail in which the non-functional segment of the anvil element is slidably mounted.

14 Claims, 4 Drawing Sheets

STAPLER WITH LEG-FLATTING AND ANVIL-GUIDING CAPABILITY

BACKGROUND OF THE INVENTION

1. Field of the Invention

The present invention relates to a stapler, and more particularly to a stapler having a leg-flatting capability and an anvil-guiding device to make an anvil move stably.

2. Description of Related Art

To improve a stapling effect, a conventional stapler has a leg-flatting device to force legs of a staple flat, such that a person and document can be prevented from being injured or broken by the legs of the staple. The leg-flatting device has an anvil element to flatten the legs of the staple, and the anvil element of the conventional stapler may be secured on a supporting base of the conventional stapler. However, there is a gap between the conventional fixed anvil element and the staple, and the gap easily causes low quality of leg-flatting effect.

Another type of conventional leg-flatting device has a slidable anvil element to solve the problem occurred by the fixed anvil element. However, the conventional stapler cannot provide a supporting effect to the slidable anvil element, the slidable anvil element is easily inclined so the leg-flatting effect is also poor.

With reference to FIG. 5, a conventional stapler has a supporting base (90) and a slidable anvil element (92). The supporting base (90) has two guiding channels (902) defined respectively in opposite side faces of the supporting base (90). The anvil element (92) is mounted moveably in supporting base (90) and has a top, two sides and two shoulders. The top is used to clinch legs of a staple and serves as a functional segment (924). The sides are mounted respectively in the guiding channels (902) and have a width larger than that of the top to form the shoulders. The sides and the shoulders serve as a non-functional segment (922). With the guiding channels (902), the anvil element (92) can slide stably during a leg-flatting process of the stapler.

However, the conventional stapler has the following drawbacks.

1. The non-functional segment (922) of the anvil element (92) is not completely mounted in, but partially exposed from the guiding channels (902). The movement of the anvil element (92) is easily influenced. For example, the anvil element (92) may be blocked by an object at a position between the non-functional segment (922) and a corresponding side face of the supporting base (90) to cause unstable movement of the anvil element (92).

2. The anvil element (92) must have sufficient width to be held in the guiding channels (902) in the side faces of the supporting base (90), or the supporting base (90) must have sufficient width to fit with that of the anvil element (92). Therefore, the sizes of the other elements of the stapler are limited accordingly, so the design range for a stapler is also limited.

To overcome the shortcomings, the present invention tends to provide a stapler to mitigate or obviate the aforementioned problems.

SUMMARY OF THE INVENTION

The main objective of the invention is to provide a stapler having a leg-flatting capability and an anvil-guiding device to make an anvil move stably.

The stapler comprises a supporting base, a magazine assembly, a trigger assembly, a leg-flatting device and a rail assembly. The supporting base has a bottom face. The magazine assembly is connected pivotally to the supporting base. The trigger assembly is connected pivotally to the supporting base. The leg-flatting device is mounted on the supporting base and has a moving base and an anvil element. The moving base is connected operationally to the supporting base and has an anvil hole defined through the moving base. The anvil element is mounted moveably in the anvil hole in the moving base and has a functional segment mounted moveably in the anvil hole and a non-functional segment. The rail assembly mounted on and protrudes from the bottom face of the supporting base and comprises at least one rail bracket protruding from the bottom face of the supporting base. Each one of the at least one rail bracket has a rail in which the non-functional segment of the anvil element is slidably mounted.

Other objects, advantages and novel features of the invention will become more apparent from the following detailed description when taken in conjunction with the accompanying drawings.

DETAILED DESCRIPTION OF PREFERRED EMBODIMENT

Figure 1:
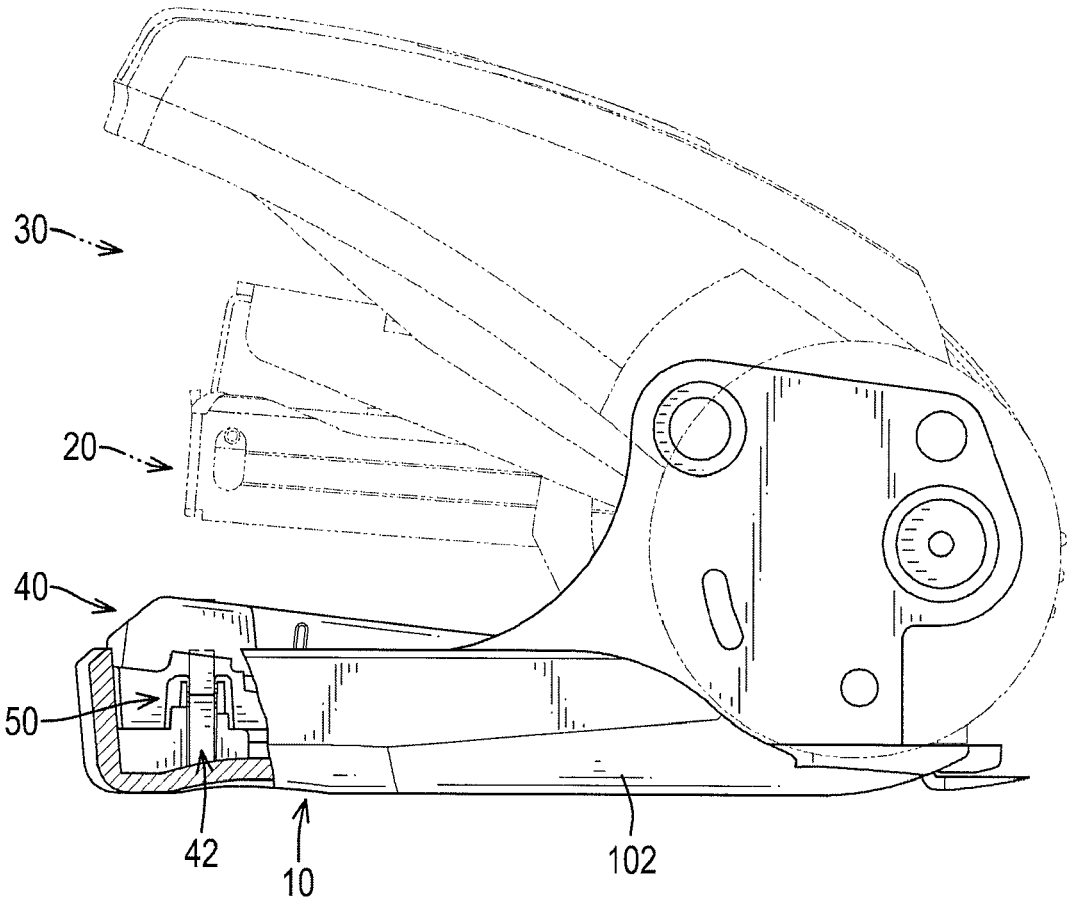
FIG. 1 is a side view in partial section of a stapler in accordance with the present invention.
Figure 2:
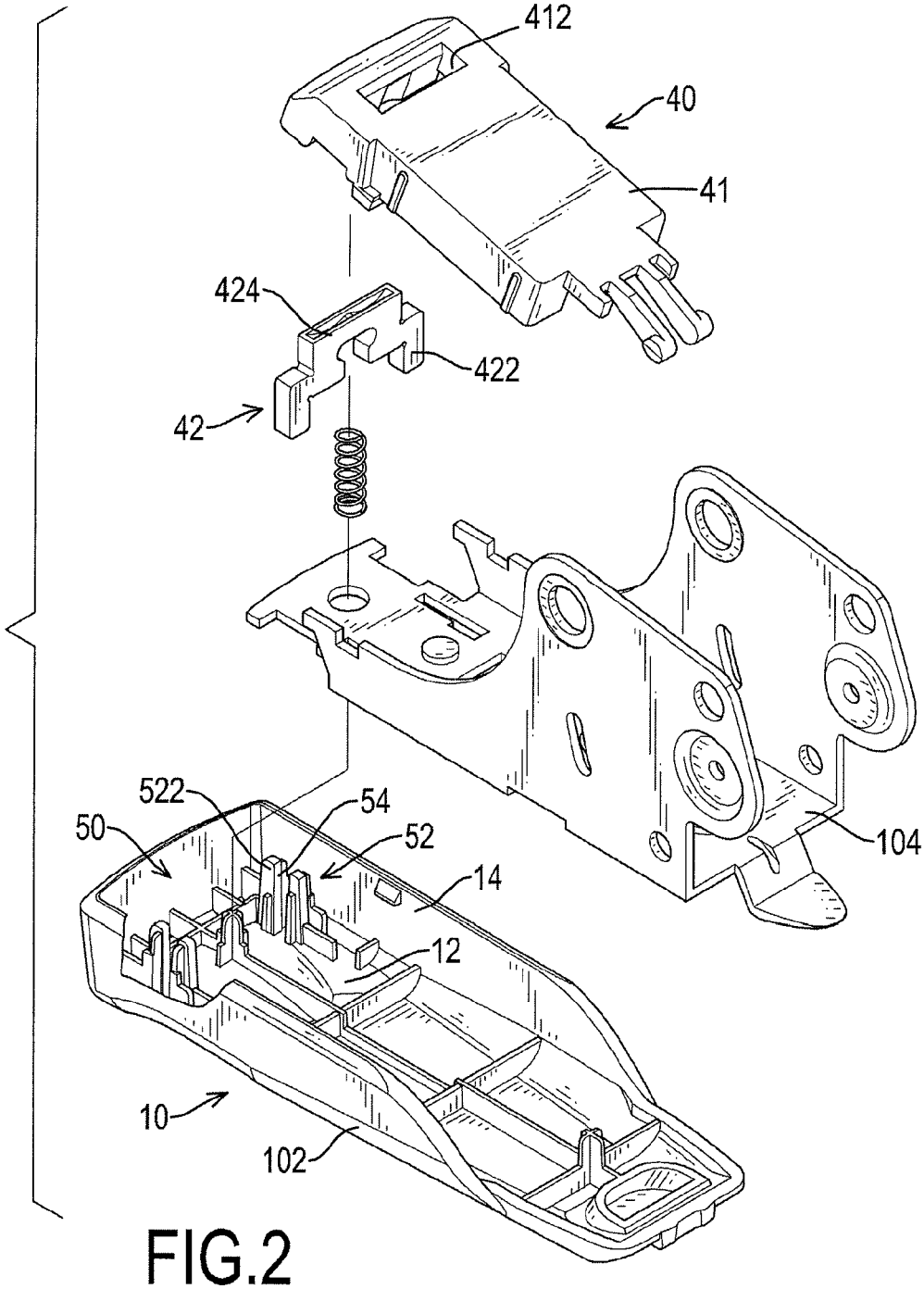
FIG. 2 is a partially exploded perspective view in partial section of the stapler in FIG. 1.
Figure 3:
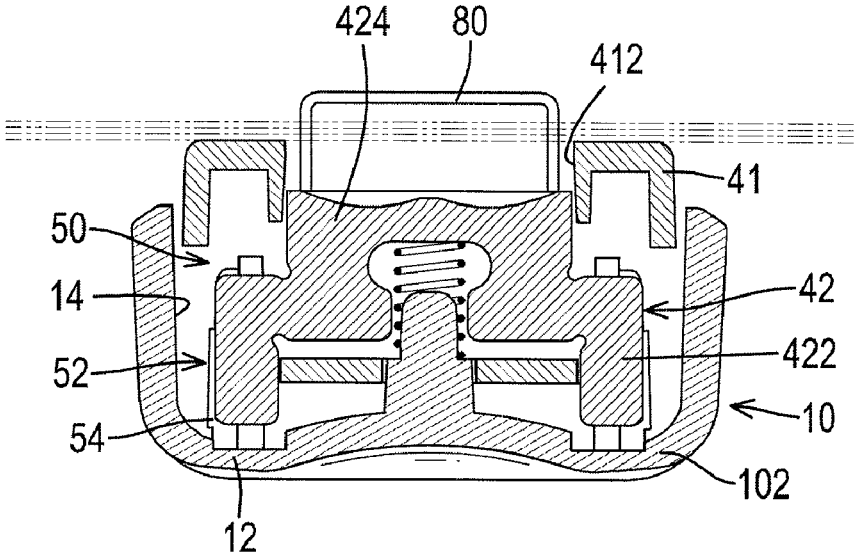
FIG. 3 is an operational front view in partial section of the stapler in FIG. 1 before a leg-flatting process.

With reference to FIGS. 1 to 3, a stapler in accordance with the present invention comprises a supporting base (10), a magazine assembly (20), a trigger assembly (30), a leg-flatting device (40) and a rail assembly (50).

The supporting base (10) has a bottom face (12) and two side faces (14) and may comprise a lower base (102) and an upper base (104). The lower base (102) may be plastic and has a U-shaped cross section to form a bottom and two sides. The bottom and the sides of the lower base (102) can serve respectively as the bottom face (12) and the side faces (14) of the supporting base (10). The upper base (104) may be metal, is mounted in the lower base (102) and has a U-shaped cross section. The magazine assembly (20) is connected pivotally to the supporting base (10) and holds staples inside. The trigger assembly (30) is connected pivotally to the supporting base (10) above the magazine assembly (20). The leg-flatting device (40) is mounted on the supporting base (10) and has a moving base (41) and an anvil element (42). The moving base (41) is connected operationally to the supporting base (10) and has an anvil hole (412) defined through the moving base (41). The anvil element (42) is mounted moveably in the anvil hole (412) in the moving base (41), is supported by a spring and has a top, two sides and two shoulders. The top of the anvil element (42) is mounted moveably in the anvil hole (412) and is used to clinch legs of a staple (80) and serves as a functional segment (424). The sides of the anvil element (42) have a width larger than that of the top to form the shoulders. The sides and the shoulders are not used to clinch the legs of the staple (80) and serve as a non-functional segment (422). The supporting base (10), the magazine assembly (20), the trigger assembly (30) and the leg-flatting device (40) may be conventional, so detail of the structures of these elements are omitted.

The rail assembly (50) is mounted on and protrudes from the bottom face (12) of the supporting base (10) and comprises at least one rail bracket (52). The at least one rail bracket (52) is mounted on and protrudes from the bottom face (12) of the supporting base (10) and is separated from the side faces (14) of the supporting base (10). In a preferred embodiment, the rail assembly (50) has two rail brackets (52). Each rail bracket (52) has a rail (54) in which the non-functional segment (422) of the anvil element (42) is slidably mounted, and the rails (54) of the rail brackets (52) are aligned with each other. Each rail bracket (52) is composed of multiple posts (522) separated from each other to define the rail (54) between the posts (522). In the preferred embodiment, each rail bracket (52) is composed of two posts (522) that are arranged in parallel or three posts (522) that are arranged triangularly.

Figure 4:
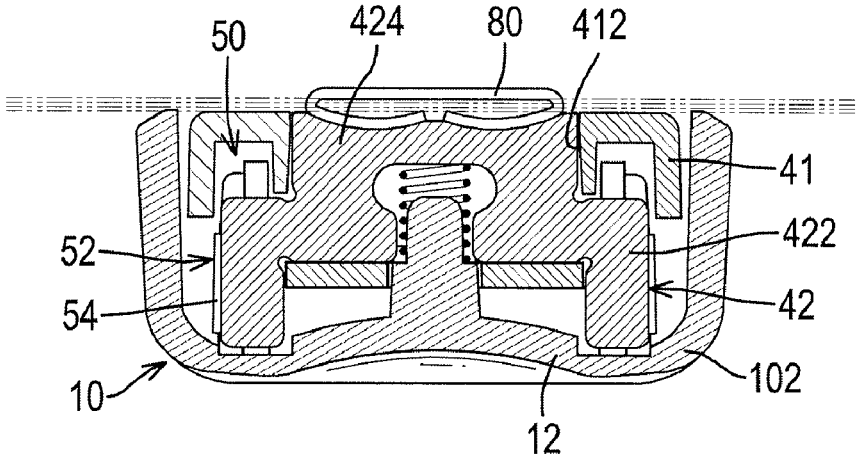
FIG. 4 is an operational front view in partial section of the stapler in FIG. 1 showing a leg-flatting process.
Figure 5:
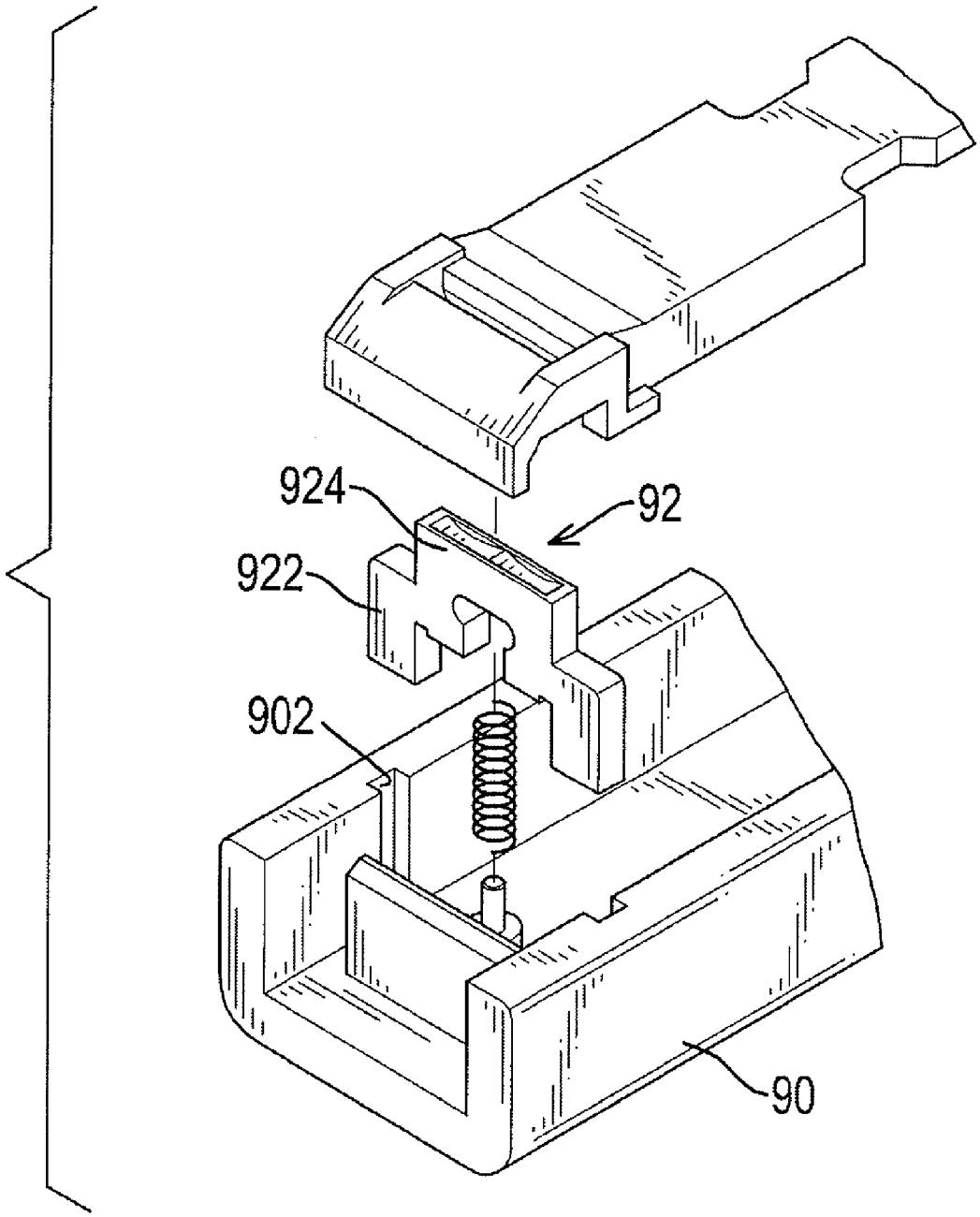
FIG.5 PRIOR ART
FIG. 5 is a partially exploded perspective view of a conventional stapler in accordance with the prior art.

With reference to FIGS. 1, 3 and 4, when the trigger assembly (30) is pressed, the trigger assembly (30) is pivoted downward to release one of the staples (80) from the magazine assembly (20). Legs of the released staple (80) will extend through stapled documents and abut with the functional segment (424) on the anvil element (42), which is exposed from the anvil hole (412) in the moving base (41). Accordingly, the functional segment (424) of the anvil element (42) will bend and clinch the legs of the released staple (80) and the anvil element (42) will move downward along the rails (54) of the rail assembly (50). When the trigger assembly (30) is released, the anvil element (42) can be moved to an original position with the force provided by the spring along the rails (54).

With the movement of the anvil element (42), the slidable anvil element (42) can solve the problem of the conventional fixed anvil assembly due to the gap between a staple and the fixed anvil element. With the arrangement of the rail assembly (50), the anvil element (42) can move stably along the rails (54) of the rail assembly (50), such that the stapling and the leg-flatting effects of the stapler are improved.

Additionally, with the non-functional segment (422) of the anvil element (42) being covered by and under the moving base (41), only the functional segment (424) is exposed from the anvil hole (412) in the moving base (41). An object is kept from a position between the non-functional segment (424) of the anvil element (42) and the side faces (14) of the supporting base (10), so the movement of the anvil element (42) will not be influenced or blocked. Furthermore, with the non-functional segment (422) of the anvil element (42) being held in the rails (54) in the rail brackets (52) that are separated and away from the side faces (14) of the supporting base (10), the widths of the anvil element (42) and the supporting base (10) are not limited by each other. Accordingly, sizes of the other elements of the stapler are not limited, so the design range for a stapler is enhanced and versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stapler comprising:

a supporting base having a bottom face;

a magazine assembly connected pivotally to the supporting base;

a trigger assembly connected pivotally to the supporting base above the magazine assembly;

a leg-flatting device mounted on the supporting base and having a moving base connected operationally to the supporting base and having an anvil hole defined through the moving base; and an anvil element mounted moveably in the anvil hole in the moving base and having a functional segment mounted moveably in the anvil hole; and a non-functional segment; and a rail assembly mounted on and protruding from the bottom face of the supporting base and comprising at least one rail bracket protruding from the bottom face of the supporting base and each one of the at least one rail bracket having a rail in which the non-functional segment of the anvil element is slidably mounted, wherein the supporting base has two side faces; and the at least one rail bracket of the rail assembly is separated from the side faces of the supporting base.

2. The stapler as claimed in claim 1, wherein each one of the at least one rail bracket is composed of multiple posts separated from each other to define the rail between the posts.

3. The stapler as claimed in claim 2, wherein each one of the at least one rail bracket is composed of two posts.

4. The stapler as claimed in claim 3, wherein the rail assembly has two rail brackets.

5. The stapler as claimed in claim 4, wherein the supporting base has two side faces; and the rail brackets of the rail assembly are separated respectively from the side faces of the supporting base.

6. The stapler as claimed in claim 5, wherein the rails of the rail brackets are aligned with each other.

7. The stapler as claimed in claim 6, wherein the non-functional segment of the anvil element is covered by and under the moving base.

8. The stapler as claimed in claim 7, wherein the supporting base comprises a lower base having a U-shaped cross section to form a bottom and two sides; and an upper base mounted in the lower base and having a U-shaped cross section.

9. The stapler as claimed in claim 8, wherein the bottom and the sides of the lower base are served respectively as the bottom face and the side faces of the supporting base.

10. The stapler as claimed in claim 1, wherein the non-functional segment of the anvil element is covered by and under the moving base.

11. The stapler as claimed in claim 10, wherein the supporting base comprises a lower base having a U-shaped cross section to form a bottom and two sides; and an upper base mounted in the lower base and having a U-shaped cross section.

12. The stapler as claimed in claim 11, wherein the bottom and the sides of the lower base serve respectively as the bottom face and the side faces of the supporting base.

13. The stapler as claimed in claim 1, wherein the supporting base comprises a lower base having a U-shaped cross section to form a bottom and two sides; and an upper base mounted in the lower base and having a U-shaped cross section.

14. The stapler as claimed in claim 13, wherein the bottom of the lower base serves as the bottom face of the supporting base.

* * * * *